US006677059B2

(12) United States Patent
Shirakawa et al.

(10) Patent No.: US 6,677,059 B2
(45) Date of Patent: Jan. 13, 2004

(54) EL DEVICE AND MAKING METHOD

(75) Inventors: Yukihiko Shirakawa, Chuo-ku (JP); Masashi Miwa, Chuo-ku (JP); Katsuto Nagano, Chuo-ku (JP)

(73) Assignee: TDK Corporation, Tokyo (JP)

( * ) Notice: Subject to any disclaimer, the term of this patent is extended or adjusted under 35 U.S.C. 154(b) by 43 days.

(21) Appl. No.: 09/866,698

(22) Filed: May 30, 2001

(65) Prior Publication Data

US 2002/0127429 A1 Sep. 12, 2002

(30) Foreign Application Priority Data

Dec. 12, 2000 (JP) ..... 2000-378071

(51) Int. Cl.[7] ..... H05B 33/22

(52) U.S. Cl. ..... 428/690; 428/917; 313/509; 257/86; 257/87; 257/103

(58) Field of Search ..... 257/103, 86, 87; 428/690, 917; 313/504, 506, 509

(56) References Cited

U.S. PATENT DOCUMENTS 5,432,015 A * 7/1995 Wu et al. ..... 428/690
2002/0105264 A1 * 8/2002 Shirakawa et al. ..... 313/506

FOREIGN PATENT DOCUMENTS

JP 61-250993 11/1986
JP 62-44989 2/1987
JP 7-50197 2/1995

OTHER PUBLICATIONS

S. Tanaka, Monthly Magazine Display, pps. 1–10 "Recent Development of Inorganic EL Display," Apr. 1998.
X. Wu, IDW '97 pps. 593–596. "Multicolor Thin–Film Ceramic Hybrid EL Displays," 1997.
T. R. Shrout, et al., Ultrasonics Symposium, pps. 711–720, "Relaxor Ferroelectric Materials," 1990.
W. Y. Pan, et al., Japanese Journal of Applied Physics, vol. 28, No. 4, pps. 653–661, "Large Piezoelectric Effect Induced By Direct Current Bias in PMN: PT Relaxor Ferroelectric Ceramics," Apr. 1989.

* cited by examiner

*Primary Examiner*—Cynthia H. Kelly
*Assistant Examiner*—Dawn Garrett
(74) *Attorney, Agent, or Firm*—Oblon, Spivak, McClelland, Maier & Neustadt, P.C.

(57) ABSTRACT

The invention aims to solve the problem of prior art EL devices that undesirable defects form in dielectric layers, and especially the problems of EL devices having dielectric layers of lead-base dielectric material including a lowering, variation and change with time of the luminance of light emission, and thereby provide an EL device ensuring high display quality and a method for manufacturing the same at a low cost. Such objects are achieved by an EL device comprising at least an electrically insulating substrate (11) and a structure including an electrode layer (12), a dielectric layer (13, 14, 15), a light emitting layer (17) and a transparent electrode layer (19) stacked on the substrate (11), wherein the dielectric layer is a laminate including a first thick-film ceramic high-permittivity dielectric layer (13) whose composition contains at least lead, a second high-permittivity layer (14) whose composition contains at least lead, and a third high-permittivity layer (15) whose composition is free of at least lead.

20 Claims, 1 Drawing Sheet

EL DEVICE AND MAKING METHOD

BACKGROUND OF THE INVENTION

1. Technical Field

This invention relates to an EL device comprising at least an electrically insulating substrate and a structure including a patterned electrode layer on the substrate and a dielectric layer, a light emitting layer and a transparent electrode layer stacked on the electrode layer.

2. Background Art

EL devices are on commercial use as backlight in liquid crystal displays (LCD) and watches.

The EL devices utilize the phenomenon that a material emits light upon application of an electric field, known as electroluminescent phenomenon.

The EL devices include dispersion type EL devices of the structure that a dispersion of powder luminescent material or organic material in enamel is sandwiched between electrode layers, and EL devices in which a light emitting thin-film sandwiched between two electrode layers and two insulating thin films is formed on an electrically insulating substrate. For each type, the drive modes include dc voltage drive mode and ac voltage drive mode. The dispersion type EL devices are known from the past and have the advantage of easy manufacture, but their use is limited because of a low luminance and a short lifetime. On the other hand, the EL devices are currently on widespread use on account of a high luminance and a long lifetime.

FIG. 2 shows the structure of a dual insulated thin-film EL device as a typical prior art EL device. This thin-film EL device includes a transparent substrate 21 of a blue sheet glass customarily used in liquid crystal displays and plasma display panels (PDP), a transparent electrode layer 22 formed from ITO or the like in a predetermined stripe pattern to a thickness of about 0.2 to 1 $\mu$m, a thin-film transparent first insulator layer 23, a light emitting layer 24 having a thickness of about 0.2 to 1 $\mu$m, and a thin-film transparent second insulator layer 25, all stacked on the substrate 21, and a metal electrode layer 26 of Al thin film or the like which is patterned into stripes extending perpendicular to the transparent electrode layer 22. A voltage is selectively applied to a specific light-emitting material selected in the matrix formed by the transparent electrode layer 22 and the metal electrode layer 26, whereby the light-emitting material in the selected pixel emits light which comes out from the substrate 21 side. The thin-film transparent insulator layers 23, 25 have a function of restricting the current flow through the light emitting layer 24 in order to restrain breakdown of the thin-film EL device and act so as to provide stable light-emitting characteristics. Thus thin-film EL devices of this structure are on widespread commercial use.

The thin-film transparent insulator layers 23, 25 mentioned above are generally transparent dielectric thin-films of $Y_2O_3$, $Ta_2O_5$, $Al_3N_4$, $BaTiO_3$, etc. deposited to a thickness of about 0.1 to 1 $\mu$m by sputtering and evaporation techniques.

Among light emitting materials, Mn-doped ZnS which emits yellowish orange light has been often used from the standpoints of ease of deposition and light emitting characteristics. The use of light emitting materials which emit light in the primaries of red, green and blue is essential to manufacture color displays. Known as the light emitting materials are Ce-doped SrS and Tm-doped ZnS for blue light emission, Sm-doped ZnS and Eu-doped CaS for red light emission, and Tb-doped ZnS and Ce-doped CaS for green light emission.

Also, monthly magazine Display, April 1998, Tanaka, "Technical Trend of Advanced Displays," pp. 1–10, sets forth a variety of light emitting materials, for example, ZnS and Mn/CdSSe as the red light emitting material, ZnS:TbOF and ZnS:Tb as the green light emitting material, and SrS:Cr, (SrS:Ce/ZnS)n, $Ca_2Ga_2S_4$:Ce, and $Sr_2Ga_2S_4$:Ce as the blue light emitting material. Also disclosed are light emitting materials capable of emitting white light such as SrS:Ce/ZnS:Mn.

It is further disclosed in International Display Workshop (IDW), '97, X. Wu, "Multicolor Thin-Film Ceramic Hybrid EL Displays," pp. 593–596, that among the aforementioned materials, SrS:Ce is used in thin-film EL devices having a blue light emitting layer. It is also described in this article that when a light emitting layer of SrS:Ce is formed, deposition in a $H_2S$ atmosphere by an electron beam evaporation technique results in a light emitting layer of high purity.

Nevertheless, for these thin-film EL devices, a structural problem remains still unsolved. Specifically, since the insulator layer is formed by a thin film, it is difficult to manufacture displays having large surface areas while completely eliminating steps at the edge of a transparent electrode pattern and avoiding defects in the thin-film insulator introduced by debris or the like in the manufacturing process. This leaves a problem that the light emitting layer fails on account of a local drop of dielectric strength. Such defectives impose a fatal problem to display devices. This creates a substantial barrier against the widespread commercial application of thin-film EL devices as large-area displays, in contrast to liquid crystal displays and plasma displays.

To solve the problem of defects in the thin-film insulator, JP-B 7-44072 discloses an EL device which uses an electrically insulating ceramic substrate as the substrate and a thick-film dielectric material instead of the thin-film insulator underlying the light emitting layer. Since the EL device of the above patent is constructed such that light emitted by the light emitting layer is extracted from the upper side remote from the substrate as opposed to prior art thin-film EL devices, a transparent electrode layer is formed on the upper side.

Further, in this EL device, the thick-film dielectric layer is formed to a thickness of several tens to several hundreds of microns, which is several hundred to several thousand folds of the thickness of the thin-film insulator layer. This minimizes the potential of breakdown which is otherwise caused by steps of electrodes and pinholes formed by debris in the manufacturing process, offering the advantages of high reliability and high yields during manufacture. Meanwhile, the use of such a thick-film dielectric layer entails a problem that the effective voltage applied across the light emitting layer drops. For example, the above-referred JP-B 7-44072 overcomes this problem by using a complex perovskite high-permittivity material containing lead in the dielectric layer.

However, the light emitting layer formed on the thick-film dielectric layer has a thickness of several hundreds of nanometers which is merely about 1/100 of that of the thick-film dielectric layer. This requires that the thick-film dielectric layer on the surface be smooth at a level below the thickness of the light emitting layer although a conventional thick-film procedure is difficult to form a dielectric layer having a fully smooth surface.

Specifically, the thick-film dielectric layer is essentially constructed of a ceramic material obtained using a powder raw material. Then intense sintering generally brings about a volume contraction of about 30 to 40%. Unfortunately, although customary ceramics consolidate through three-dimensional volume contraction upon sintering, thick-film ceramics formed on substrates cannot contract in the in-plane directions of the substrate under restraint by the substrate, and is allowed for only one-dimensional volume contraction in the thickness direction. For this reason, sintering of the thick-film dielectric layer proceeds insufficiently, resulting in an essentially porous body. Moreover, since the surface roughness of the thick-film is not reduced below the crystal grain size of the polycrystalline sintered body, its surface have asperities greater than the submicron size.

In the presence of the surface defects, porosity and asperities of the dielectric layer as mentioned above, the light emitting layer that is formed thereon by vapor phase deposition techniques such as evaporation and sputtering conforms to the underlying surface profile and thus cannot be uniform. It is then difficult to effectively apply an electric field across light emitting layer regions formed on uneven areas of the substrate, resulting in a reduction of effective luminous area. On account of local unevenness of film thickness, the light emitting layer undergoes partial breakdown, resulting in a lowering of emission luminance. Moreover, since the film thickness has large local variations, the strength of the electric field applied across the light emitting layer has large local variations as well, failing to provide a definite emission voltage threshold.

To solve these and other problems, for example, JP-A 7-50197 discloses a procedure of improving surface smoothness by stacking on a thick-film dielectric of lead niobate a high-permittivity layer of lead titanate zirconate or the like to be formed by the sol-gel technique.

The use of ceramic high-permittivity dielectric thick-films in this way makes it possible to avoid steps at the pattern edge of lower electrode layer, and defects introduced in thin-film insulator by debris during the manufacturing process, thereby solving the problem that the light emitting layer can break down on account of local drops of dielectric strength.

However, EL devices using such prior art ceramic high-permittivity thick-films have to use lead base dielectric layers as the high-permittivity thick-film layer in order to acquire such characteristics as low-temperature sintering ability, high permittivity and high dielectric strength. Unfortunately, where lead base dielectric materials are used as the dielectric layer material, the light emitting layer formed on the dielectric layer can react with lead components in the dielectric layer, resulting in a lowering of initial emission luminance, luminance variations, and changes with time of emission luminance, all undesirable on practical use.

SUMMARY OF THE INVENTION

An object of the invention is to provide an EL device which has solved the lowering, variations, and changes with time of emission luminance of EL devices using lead base dielectric materials, and affords high display quality without increasing the cost.

This and other objects are attained by the construction defined below as (1) to (7).

(1) An EL device comprising at least an electrically insulating substrate and a structure including an electrode layer, a dielectric layer, a light emitting layer and a transparent electrode layer stacked on the substrate in the described order, wherein said dielectric layer is a laminate including a first thick-film ceramic high-permittivity dielectric layer whose composition contains at least lead, a second high-permittivity layer whose composition contains at least lead, and a third high-permittivity layer whose composition is free of at least lead.

(2) The EL device of (1) wherein said third high-permittivity layer is formed of a perovskite structure dielectric material whose composition is free of at least lead.

(3) The EL device of (1) or (2) wherein said second and third high-permittivity layers are formed by a solution coating-and-firing technique.

(4) The EL device of (1) or (2) wherein said second high-permittivity layer is formed by a solution coating-and-firing technique, and said third high-permittivity layer is formed by a sputtering technique.

(5) An EL device comprising at least an electrically insulating substrate and a structure including an electrode layer, a dielectric layer, a light emitting layer and a transparent electrode layer stacked on the substrate in the described order, wherein said dielectric layer is a laminate including a thick-film ceramic high-permittivity dielectric layer whose composition contains at least lead and a second high-permittivity layer formed of a dielectric material whose composition is free of at least lead.

(6) The EL device of (5) wherein said second high-permittivity layer is formed of a perovskite structure dielectric material whose composition is free of at least lead.

(7) The EL device of (5) or (6) wherein said second high-permittivity layer is formed by a solution coating-and-firing technique.

DESCRIPTION OF THE PREFERRED EMBODIMENTS

The EL device of the invention has at least an electrically insulating substrate and a structure including an electrode layer, a dielectric layer, a light emitting layer and a transparent electrode layer stacked on the substrate in the described order.

The dielectric layer has a laminate structure including a first dielectric layer in the form of a lead-base, high-permittivity, thick-film ceramic dielectric layer, and a second high-permittivity layer which is preferably formed by a solution coating-and-firing technique in order to improve the smoothness of the thick-film ceramic surface. The second high-permittivity layer is further constructed by a laminate structure of a lead-base, high-permittivity film and a non-lead-base high-permittivity film, or the second high-permittivity layer is wholly constructed by a dielectric film whose composition is free of lead.

The lead-base dielectric as used herein means a dielectric material which contains lead in its composition, and the non-lead-base (high-permittivity) dielectric layer means a dielectric material which does not contain lead in its composition. In particular, the non-lead-base dielectric material means a dielectric material having the perovskite crystal structure and containing elements other than lead at A sites.

Figure 1:
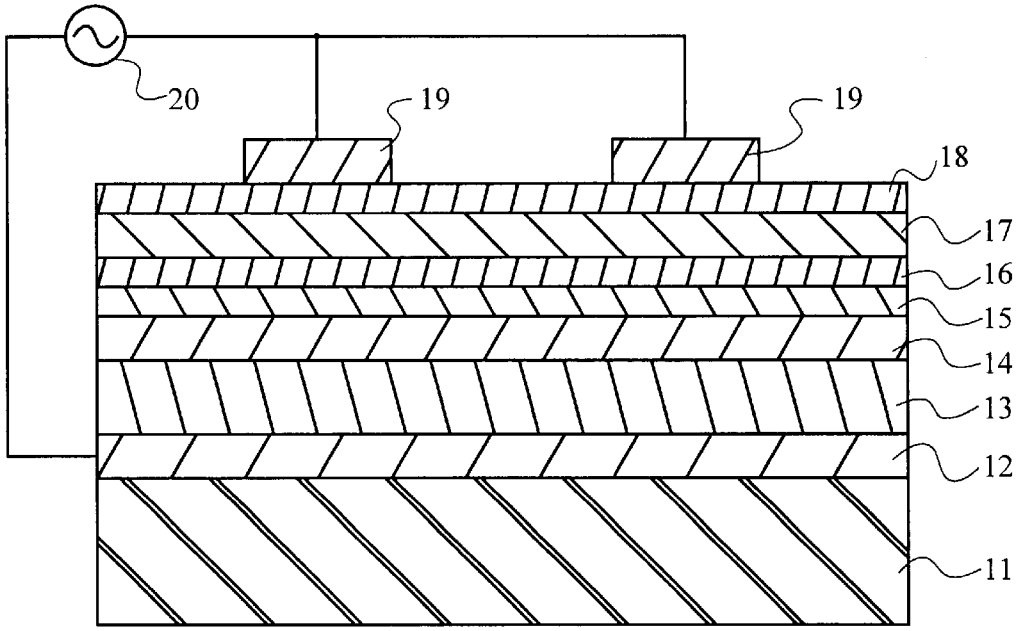
FIG. 1 is a fragmentary schematic cross-sectional view showing the basic construction of the inventive EL device.
Figure 2:
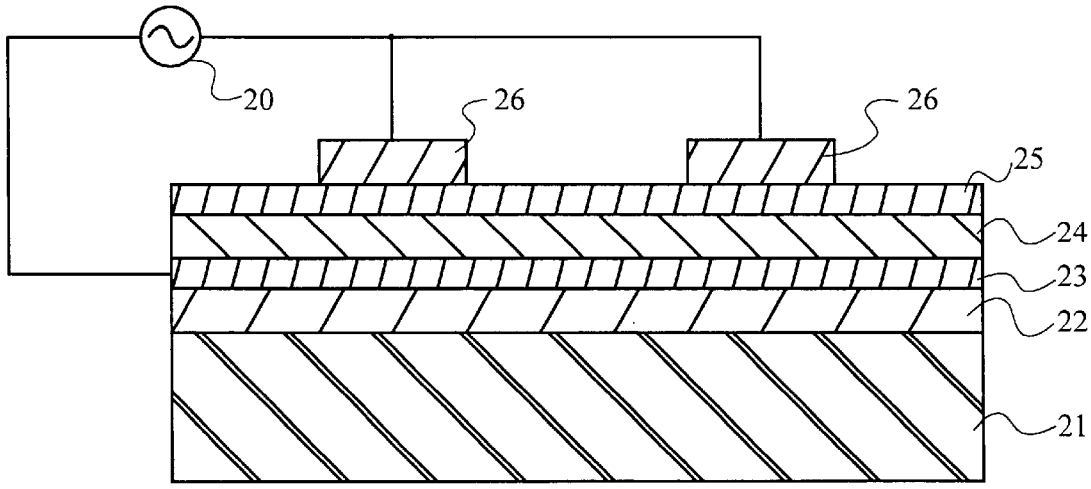
FIG. 2 is a fragmentary schematic cross-sectional view showing the basic construction of a prior art EL device.

FIG. 1 illustrates the basic structure of the EL device according to the invention. The inventive EL device includes, for example, on an electrically insulating substrate 11, a lower electrode layer 12 formed on the substrate 11 to a predetermined pattern, a lead-base thick-film ceramic dielectric layer 13 on the lower electrode layer 12, and a lead-base dielectric layer 14 and a non-lead-base dielectric layer 15 on the surface of the layer 13, which dielectric layers constitute a multilayer dielectric layer.

Stacked on the laminate dielectric layer 13, 14, 15 are a thin-film insulator layer 16, a light emitting layer 17, a thin-film insulator layer 18, and a transparent electrode layer 19. It is understood that the thin-film insulator layers 16 and 18 may be omitted. The lower electrode layer 12 and the upper transparent electrode layer 19 are formed in stripe patterns of orthogonally extending lines. By selecting any line of lower electrode layer 12 and any line of upper transparent electrode layer 19, and selectively applying a voltage across the light emitting layer at the intersection of the selected electrodes from an AC power supply/pulse supply 20, light emission from the selected pixel is obtainable.

The substrate is not critical as long as it is electrically insulating, does not contaminate the lower electrode layer and dielectric layer to be formed thereon, and maintains a predetermined heat resistant strength.

Illustrative materials include ceramic substrates of alumina ($Al_2O_3$), quartz glass ($SiO_2$), magnesia (MgO), forsterite ($2MgO.Si_2$), steatite ($MgO.SiO_2$), mullite ($3Al_2O_3$, $2SiO_2$), beryllia (BeO), zirconia ($ZrO_2$), aluminum nitride (AlN), silicon nitride (SiN), and silicon carbide (SiC) as well as crystallized glass, heat resistant glass or the like. Enamel-coated metal substrates can also be used.

The lower electrode layer is formed, in the case of a passive matrix type, to a stripe pattern of plural lines. The line width is the width of one pixel. Since the space between lines becomes a non-luminous region, it is preferred to keep the space between lines as small as possible. Illustratively, a line width of about 200 to 500 $\mu$m and a space of about 20 to 50 $\mu$m, for example, are necessary although these values depend on the desired resolving power of the display.

The material of the lower electrode layer is preferably one which has a high electric conductivity, is not damaged upon formation of the dielectric layer, and is least reactive with the dielectric layer and light emitting layer. Preferred lower electrode layer materials are noble metals such as Au, Pt, Pd, Ir and Ag, noble metal alloys such as Au—Pd, Au—Pt, Ag—Pd and Ag—Pt, and electrode materials based on noble metals and having base metal elements added such as Ag—Pd—Cu because they readily exhibits oxidation resistance in an oxidizing atmosphere during firing of the dielectric layer. Also useful are conductive oxide materials such as ITO, $SnO_2$(tin oxide film) and ZnO—Al. It is also possible to use base metals such as Ni and Cu, as long as the oxygen partial pressure during firing of the dielectric layer is set in the range where the base metals are not oxidized. The lower electrode layer may be formed by well-known techniques such as sputtering, evaporation and plating.

The thick-film dielectric layer should have a high permittivity and high dielectric strength and is further required to be low-temperature sinterable, with the heat resistance of the substrate being taken into account.

The thick-film dielectric layer as used herein means a ceramic layer which is formed by firing a powder insulating material according to the so-called thick-film technique. The thick-film dielectric layer may be formed, for example, by mixing a powder insulating material with a binder and a solvent to form an insulating paste, and printing the insulating paste onto the substrate having the lower electrode layer borne thereon, followed by firing. Alternatively, it may be formed by casting the insulating paste to form green sheets, and placing the green sheets one on top of another.

Binder removal prior to the firing may be effected under conventional conditions.

The atmosphere during firing may be determined as appropriate, depending on the type of conductor in the electrode layer-forming paste. Where firing is effected in an oxidizing atmosphere, conventional firing in air is acceptable.

The holding temperature during firing may be determined as appropriate depending on the type of the insulator layer although it is usually in the range of about 700 to 1200° C., preferably up to 1,000° C. The holding time during firing is preferably 0.05 to 5 hours, especially 0.1 to 3 hours.

If desired, annealing treatment is carried out.

Provided that the thick-film dielectric layer and the light emitting layer have a relative permittivity e1 and e2 and a thickness d1 and d2, respectively, and a voltage Vo is applied between the upper electrode layer and the lower electrode layer, the voltage V2 applied across the light emitting layer is represented by the following formula.

$$V2/Vo=(e1\times d2)/(e1\times d2+e2\times d1) \quad (1)$$

If the light emitting layer has a relative permittivity e2=10 and a thickness d2=1 $\mu$m, this gives the following formula.

$$V2/Vo=e1/(e1+10\times d1) \quad (2).$$

Since the effective voltage applied across the light emitting layer is at least 50%, preferably at least 80%, and more preferably at least 90% of the applied voltage, the following is derived from the above formula.

$$\text{In case} \geqq 50\%,\ e1 \geqq 10\times d1 \quad (3)$$

$$\text{In case} \geqq 80\%,\ e1 > 40\times d1 \quad (4)$$

$$\text{In case} \geqq 90\%,\ e1 > 90\times d1 \quad (5)$$

Namely, the relative permittivity of the dielectric layer must be at least 10 folds, preferably at least 40 folds, and more preferably at least 90 folds of its thickness expressed in micron ($\mu$m) unit.

The thickness of the thick-film dielectric layer must be large enough to avoid formation of pin holes by steps of the electrode and dust and debris during the manufacturing process, and specifically, at least 10 $\mu$m, preferably at least 20 $\mu$m, and more preferably at least 30 $\mu$m.

For instance, when the dielectric layer has a thickness of 20 $\mu$m, its relative permittivity must be at least 200–800–1800. When the dielectric layer has a thickness of 30 $\mu$m, its relative permittivity must be at least 300–1200–2700.

A variety of materials are contemplated as the high-permittivity thick-film material. When the limit by the heat resistance of the substrate material is taken into account, the material must be a high-permittivity ceramic composition capable of low-temperature sintering.

Dielectric materials containing lead in their composition are preferred in that they are readily sinterable at low temperatures because the melting point of lead oxide is as low as 888° C. and a liquid phase is formed at low temperatures of about 700 to 800° C. between lead oxide and another oxide base material such as $SiO_2$, CuO, $Bi_2O_3$, or $Fe_2O_3$, and because a high permittivity is readily available. Preferred materials used herein are, for example, perovskite structure dielectric materials such as $Pb(Zr_xTi_{1-x})O_3$, complex perovskite relaxation type ferroelectric materials as typified by $Pb(Mg_{1/3}Ni_{2/3})O_3$, and tungsten bronze type ferroelectric materials as typified by $PbNb_2O_6$.

Examples of the perovskite type materials include lead-base perovskite compounds such as lead zirconate titanate (PZT) and lead lanthanum zirconate titanate (PLZT).

Of the perovskite type materials, lead-base perovskite compounds generally have the chemical formula: $ABO_3$ wherein A and B each are a cation. A is lead, which may be substituted in part with one or more of Ba, Ca and Sr. B is preferably one or more elements selected from Ti, Zr, Hf, Ta, Sn and Nb.

Illustrative are lead-base perovskite compounds such as PZT and PLZT both containing lead. These compounds may be partially substituted at A and B sites with the above-described elements. It is noted that PZT is a $PbZrO_3$–$PbTiO_3$ base solid solution, and PLZT is a compound obtained by doping PZT with La and has the formula: $(Pb_{0.89-0.91}La_{0.11-0.09})(Zr_{0.65}Ti_{0.35})O_3$ as expressed in terms of $ABO_3$.

Representative of the tungsten bronze type materials are tungsten bronze type oxides including lead niobate, lead barium niobate (PBN), $PbNb_2O_6$, $PbTa_2O_5$ and $PbNb_4O_{11}$.

Preferred among these tungsten bronze type materials are the tungsten bronze type materials described in the list of ferroelectric materials in Landoit-Borenstein, Vol. 16. The tungsten bronze type materials generally have the chemical formula: $A_yB_5O_{15}$ wherein A and B each are a cation. A is lead, which may be substituted in part with one or more elements of Mg, Ca, Ba, Sr, Rb, Tl, rare earth and Cd. B is preferably one or more elements selected from Ti, Zr, Ta, Nb, Mo, W, Fe and Ni.

Preferred examples include tungsten bronze type oxides such as $(Ba,Pb)Nb_2O_6$, $PbNb_2O_6$, $PbTa_2O_6$, $PbNb_4O_{11}$, $PbNb_2O_6$ and lead niobate and solid solutions thereof.

Examples of the complex perovskite relaxation type ferroelectric materials used herein include ferroelectric materials such as PFN:$Pb(Fe_{1/2}Nb_{1/2})O_3$, PFW:$Pb(Fe_{1/3}W_{2/3})O_3$, PMN:$Pb(Mg_{1/3}Ni_{2/3})O_3$, PNN:$Pb(Ni_{1/3}Nb_{2/3})O_3$, PMW:$Pb(Mg_{1/2}W_{1/2})O_3$, PT:$PbTiO_3$, PZ:$PbZrO_3$, PZN:$Pb(Zn_{1/3}Nb_{2/3})O_3$, and lead lanthanum zirconate titanate (PLZT) as well as doped or modified relaxors such as modified lead magnesium niobates $Pb(Mg_{1/3}Nb_{2/3})O_3$—$PbTiO_3$, also known as modified PMN or PMN-PT, as described in Shrout et al., "Relaxor Ferroelectric Materials," Proceedings of 1990 Ultrasonic Symposium, pp. 711–720, and Pan et al., "Large Piezoelectric Effect Induced by Direct Current Bias in PMN: PT Relaxor Ferroelectric Ceramics," Japanese Journal of Applied Physics, Vol. 28, No. 4 (April 1989), pp. 653–661.

When these materials are used, a dielectric layer having a relative permittivity of 1,000 to 10,000 can be readily formed by firing at a temperature of 800 to 900° C. which is the upper limit heat resistant temperature of conventional ceramic substrates such as alumina ceramics.

The high-permittivity dielectric layer overlying the thick-film dielectric layer must use a solution coating-and-firing technique since its purpose is to improve the surface smoothness of the thick-film dielectric layer.

The solution coating-and-firing technique as used herein encompasses techniques of applying a dielectric precursor solution to a substrate, followed by firing to form a dielectric layer, such as sol-gel technique and MOD technique.

The sol-gel technique is generally a technique of adding a predetermined amount of water to a metal alkoxide in a solvent, effecting hydrolysis and polycondensation to form a sol precursor solution having M—O—M bonds, applying the precursor solution to a substrate, and firing to form a film. The MOD (metallo-organic decomposition) technique is a technique of dissolving a metal salt of carboxylic acid having M—O bonds in an organic solvent to form a precursor solution, applying the precursor solution to a substrate, and firing to form a film. The precursor solution designates a solution containing intermediate compounds formed by dissolving starting compounds in a solvent, in the sol-gel, MOD and other film forming techniques.

The sol-gel and MOD techniques are not completely separate techniques, but are generally used in combination. For example, when a film of PZT is formed, it is a common practice to prepare a solution using lead acetate as the lead source and alkoxides as the Ti and Zr sources. Sometimes, both the sol-gel and MOD techniques are generally referred to as sol-gel technique. Since a film is formed in either case by applying a precursor solution to a substrate followed by firing, the relevant technique is referred herein as the "solution coating-and-firing technique." A solution obtained by mixing dielectric particles of submicron size with a dielectric precursor solution is encompassed within the concept of the dielectric precursor solution as used in the present invention, and a procedure of applying that solution to a substrate followed by firing is also encompassed within the concept of the solution coating-and-firing technique as used in the present invention.

The solution coating-and-firing technique in which elements constituting the dielectric are intimately mixed on the order below submicron, independent of whether it is the sol-gel or MOD technique, is characterized by a possibility to synthesize dense dielectrics at very low temperatures, as compared with the techniques essentially relying on ceramic powder sintering as in the formation of dielectric by the thick-film technique.

The dielectric layer formed by this technique is characterized in that because it is formed by way of the steps of applying a precursor solution and firing, it is formed thick in recesses of the substrate and thin on protrusions of the substrate so that steps on the substrate surface are smoothed. Then the major purpose of using the solution coating-and-firing technique is to substantially improve the surface smoothness of the thick-film ceramic dielectric layer in EL device and to enable to significantly improve the uniformity of a thin-film light emitting layer to be formed thereon.

Accordingly, the dielectric layer formed by the solution coating-and-firing technique should desirably have a thickness of at least 0.5 $\mu$m, preferably at least 1 $\mu$m, more preferably at least 2 $\mu$m, in order to fully smooth asperities on the thick film surface.

Described below is the influence of stacking of a dielectric layer by the solution coating-and-firing technique on the relative permittivity of the overall dielectric layer. Provided that a thick-film dielectric layer and a high-permittivity dielectric layer formed by the solution coating-and-firing technique have a relative permittivity e3 and e4 and a total (for each) thickness d3 and d4, respectively, the overall multilayer dielectric layer obtained by stacking the foregoing layers has an effective relative permittivity e5 given by the following formula. It is noted that permittivity is calculated on the assumption that the thickness of the overall multilayer dielectric layer is kept unchanged at d3.

$$e5=e3\times 1/[1+(e3/e4)\times(d4/d3)] \quad (6)$$

This formula is rewritten as follows.

$$e4/d4=e3\times e5/(d3\times(e3-e5)) \quad (7)$$

As understood from the foregoing discussion, the effective relative permittivity of the overall multilayer dielectric layer resulting from addition of high-permittivity dielectric layers formed by the solution coating-and-firing technique is preferably 1,200 to 2,700 or higher when the thick-film layer has a thickness of 30 $\mu$m. Then when it is desired to gain an effective permittivity of 2,700 using a thick film having a relative permittivity of 4,000, the ratio of the relative permittivity to thickness of the dielectric layer formed by the solution coating-and-firing technique must be 277 or higher. This ratio is 900 when the thick-film dielectric layer has a permittivity of 3,000.

Since the dielectric layer formed by the solution coating-and-firing technique has a thickness of at least 0.5 $\mu$m, preferably at least 1 $\mu$m, and more preferably at least 2 $\mu$m as described above, its relative permittivity is desired to be high, even a little, and is at least 250, preferably at least 500.

It is thus evident that the high-permittivity layer formed by the solution coating-and-firing technique should have a large thickness and a high permittivity. Ferroelectric materials having a perovskite structure, typically PZT are conventionally used in consideration of matching with a lead-base thick-film dielectric layer and low-temperature synthesis.

It is well known that in synthesizing lead-base dielectric ceramic thick films, the starting composition should be a lead excessive composition. In order to sinter lead-base dielectric ceramic thick films at temperatures as low as 800 to 900° C., it is indispensable to add a sintering aid capable of forming a liquid phase at the temperature, and such a sintering aid utilizes low-temperature liquid phase-forming reaction of lead oxide with another oxide base material as previously mentioned; and lead components can evaporate during sintering. The lead excessive composition compensates for these factors.

It is also well known that when a dielectric layer having a lead base perovskite structure such as PZT is formed by the solution coating-and-firing technique, lead component has to be added in more excess (about 5% to 20%) than in the case of ceramics.

The reasons why a more excess of lead component is necessary in the case of the solution coating-and-firing technique are that the excessive lead component is effective to avoid that the lead component evaporates during firing and leads becomes short to restrain crystal growth; that the excessive lead component constitutes low melting composition zones to facilitate material diffusion during crystal growth and enable reaction at low temperatures; that due to low-temperature reaction as compared with conventional ceramics, there is a tendency that the excessive lead component is taken in grown dielectric crystal grains as compared with the case of ceramics; that since the excessive lead component has a reduced diffusion distance, a more lead component is necessary to maintain a fully lead excessive state at every crystal growth site.

The dielectric layer formed from a lead-base dielectric material having lead component added in excess for the above reasons is characterized in that the layer contains a large quantity of the excessive lead component in the form of lead oxide in addition to the lead component incorporated in the crystal structure.

The excessive lead component will readily precipitate from within the dielectric layer under heat loads applied after formation of the dielectric layer, especially under heat loads in a reducing atmosphere. Especially under heat loads in a reducing atmosphere, there is a likelihood for lead oxide to be reduced into metallic lead. If a light emitting layer to be described later is formed directly on the dielectric layer under such conditions, there can occur reaction of the lead component with the light emitting layer and contamination of the light emitting layer with mobile metallic lead ions, resulting in a drop of emission luminance and a detrimental influence on long-term reliability.

In particular, metallic lead ions have a high ion migration capability and have a noticeable influence on luminous characteristics as mobile ions within the light emitting layer across which a high electric field is applied and hence, a significant influence on long-term reliability.

Even when lead oxide is not reduced to metallic lead in a reducing atmosphere, the presence of the lead oxide component within the light emitting layer can adversely affect reliability because lead oxide is reduced by electron bombardments within the light emitting layer under a high electric field and thus liberated as metal ions.

In addition to the lead-base dielectric layer thus formed, the EL device of the present invention has a non-lead-base high-permittivity dielectric layer at least on the outermost surface of the lead-base dielectric layer. The non-lead-base dielectric layer as used herein means a dielectric layer formed of a substantially lead-free dielectric material. Illustrative are dielectric materials of the perovskite type, tungsten bronze types and the like. Dielectric materials of the perovskite type have at A sites elements other than lead, preferably elements other than monovalent. Representative are dielectric materials containing one or more elements of Ba, Sr, Ca and Cd at A sites and one or more elements of Ti, Zr, Sn and Hf at B sites.

More illustratively, the following materials and mixtures of two or more thereof are appropriate.

(A) Of perovskite type materials, such compounds as $BaTiO_3$ and $SrTiO_3$ generally have the chemical formula: $ABO_3$ wherein A and B each are a cation. A is preferably one or more elements selected from among Ca, Ba, Sr and Cd. B is preferably one or more elements selected from Ti, Zr and Hf.

Illustrative examples include $CaTiO_3$, $SrTiO_3$, $BaTiO_3$, $BaZrO_3$, $CaZrO_3$, $SrZrO_3$, $CdHfO_3$, $CdZrO_3$, $SrSnO_3$, and solid solutions thereof. To modify their characteristics, these compounds may be partially substituted with any of the above-mentioned elements or doped with a trace amount of element, preferably trivalent.

(B) Examples of the tungsten bronze type materials include tungsten bronze type oxides as typified by strontium barium niobate (SBN) and solid solutions thereof. To modify their characteristics, these compounds may be partially substituted with any of the above-mentioned elements or doped with a trace amount of element, preferably trivalent.

The non-lead-base high-permittivity dielectric layer can suppress diffusion of the lead component from the lead-base dielectric layer to the light emitting layer and prevent any detrimental influence of the excessive lead component on the light emitting layer.

Now, the influence on the relative permittivity of the dielectric layer by the addition of the non-lead-base dielectric layer is discussed again. Provided that the lead-base dielectric layer and the non-lead-base dielectric layer have a relative permittivity e6 and e7 and a total (for each) thickness d6 and d7, respectively, the overall structure of the lead-base dielectric layer and the non-lead-base dielectric layer has an effective relative permittivity e8 given by the following formula.

$$e8=e6\times 1/[1+(e6/e7)\times(d7/d6)] \quad (8)$$

A reduction of the effective relative permittivity of the lead-base dielectric layer/non-lead-base dielectric layer composite layer obtained by adding the non-lead-base dielectric layer must be small when the relationship of the relative permittivity of the dielectric layer and the light emitting layer to the effective voltage applied across the light emitting layer is considered. It is then preferred that the relative permittivity of the composite layer be at least 90%, more preferably at least 95% of that of the dielectric layer alone. The following is then derived from formula (6).

$$\text{In case } \geqq 90\%,\ e6/d6 \leqq 1/9 \times e7/d7 \quad (9)$$

$$\text{In case } \geqq 95\%,\ e6/d6 \leqq 1/19 \times e7/d7 \quad (10)$$

Provided that the lead-base dielectric layer has a relative permittivity of 2,700 and a thickness of 30 $\mu$m, for example, the ratio of the relative permittivity to thickness of the non-lead-base dielectric layer must be at least 810, preferably at least 1,710. Therefore, provided that the non-lead-base dielectric layer has a thickness of 0.2 $\mu$m, a relative permittivity of 162 to 342 or higher is necessary. Provided that the non-lead-base dielectric layer has a thickness of 0.4 $\mu$m, a relative permittivity of 324 to 684 or higher is necessary.

With respect to the thickness of the non-lead-base dielectric layer, a thicker film is preferred for the purpose of preventing lead diffusion. The inventor's empirical considerations recommend that the thickness be preferably at least 0.2 $\mu$m and more preferably at least 0.4 $\mu$m. A greater thickness is acceptable if a problem of decreasing effective relative permittivity does not arise.

Even when the non-lead-base dielectric layer has a thickness of less than 0.2 $\mu$m, the lead diffusion-preventing effect is achieved to some extent, but not to the full extent because the non-lead-base dielectric layer becomes vulnerable to microscopic surface defects and surface roughness of the lead-base dielectric layer and local surface roughness created by deposition of debris during the manufacturing process. There is a risk of raising the problem that local diffusion of the lead component can cause local reduction of luminance or local degradation of the light emitting layer.

For this reason, the non-lead-base dielectric layer desirably has a greater thickness, and the non-lead-base dielectric layer is required to have a relative permittivity of at least 100, preferably at least 200 and more preferably at least 400.

Referring again to the foregoing example wherein the lead-base dielectric layer has a relative permittivity of 2,700 and a thickness of 30 $\mu$m, if a $Si_3N_4$ film having a relative permittivity of about 7 is formed to a thickness of 0.4 $\mu$m, then the effective relative permittivity is computed to be 440 from formula (8); and if a $Ta_2O_5$ film having a relative permittivity of about 25 is formed to a thickness of 0.4 $\mu$m, then the effective relative permittivity is computed to be 1,107, indicating a substantial reduction. The effective voltage applied across the light emitting layer is substantially reduced. Then when such a non-lead-base dielectric layer is used, the drive voltage of the EL device is significantly increased at the sacrifice of practical operation.

By contrast, if a high-permittivity material, for example, a $TiO_2$ film having a relative permittivity of about 80 is formed to a thickness of 0.4 $\mu$m, the effective relative permittivity is significantly improved to 1,862; if a material having a relative permittivity of 200 is used, the effective relative permittivity is 2,288; and if a material having a relative permittivity of 400 is used, the effective relative permittivity is 2,477, indicating a possibility to acquire more than about 90% of the performance in the absence of the non-lead-based dielectric layer.

Representative of the non-lead-base high-permittivity dielectric materials having a relative permittivity of 100 to 1,000 or higher in excess of the relative permittivity of about 80 for $TiO_2$ are perovskite structure dielectrics such as $BaTiO_3$, $SrTiO_3$, $CaTiO_3$, $BaSnO_3$ and $CdHfO_3$ as exemplified above, and solid solutions of these materials such as $Ba_{1-x}Sr_xTiO_3$.

The use of perovskite structure non-lead-base dielectric layers readily enables to achieve the effect of preventing the lead component from diffusing into the light emitting layer while minimizing the reduction of effective relative permittivity.

According to the inventor's investigations, in using the perovskite structure non-lead-base dielectric layer, it is important for the composition to have such a perovskite structure that the ratio of A site atoms to B site atoms is at least 1.

More specifically, all perovskite structure non-lead-base dielectric materials as mentioned above are able to contain lead ions at A sites in their crystal structure. Reference is made to the $BaTiO_3$ composition, for example. When a $BaTiO_3$ layer is formed using a starting composition which is short of Ba as the A site atom relative to Ti as the B site atom as in $Ba_{1-x}TiO_{3-x}$,which means that excessive lead component is present in the lead-base dielectric layer to form the $BaTiO_3$ layer, the excessive lead component readily substitute at Ba defective sites in the $BaTiO_3$ layer to form a $(Ba_{1-x}Pb_x)TiO_3$ layer. If a light emitting layer is formed on the $BaTiO_3$ layer in this condition, the light emitting layer comes in direct contact with the lead component, failing to attain lead diffusion-preventing effects.

For this reason, perovskite structure non-lead-base dielectric materials should preferably be A site excessive from the stoichiometry. As will be presumed from this explanation, perovskite structure non-lead-base dielectric materials which allow for substitution of the lead component in their crystal structure have a possibility to partially react with the lead component, though only to a slight extent, in proximity to the interface with the lead-base dielectric layer, even when their composition is A site excessive from the stoichiometry. For this reason too, the thickness of the non-lead-base dielectric layer should preferably be above a certain level. According to the inventor's empirical findings, the thickness is at least 0.1 $\mu$m, and preferably at least 0.2 $\mu$m.

As the method of forming a non-lead-base dielectric layer in such a way as to fully control its composition, a sputtering or solution coating-and-firing technique is preferred because of ease of composition control.

The use of the sputtering technique in forming the non-lead-base dielectric layer is one of the preferred film forming processes because a thin film having the same composition as the target composition, especially a dense thin film having a so high density that a greater effect of preventing diffusion of the lead component is expectable can be easily formed.

Also, on use of the solution coating-and-firing technique, a dielectric layer whose composition is more strictly controlled than in the sputtering technique can be formed by controlling the preparative proportion of the precursor solution; and further advantageously, the effect of smoothing out the asperities of the underlying layer is obtainable as the feature of the dielectric layer formed by the solution coating-and-firing technique. In particular, if a high permittivity equal to that of the lead-base dielectric layer formed on the underlying layer by the solution coating-and-firing technique is available, advantageously the lead-base dielectric layer can be omitted, and only the non-lead-base dielectric layer formed by the solution coating-and-firing technique can exert both the effect of smoothing out surface asperities of the lead-based thick-film ceramic dielectric layer and the lead diffusion-preventing effect.

With respect to the combination of the lead-base dielectric layer and the non-lead-base high-permittivity dielectric layer, both formed on the lead-base thick-film ceramic dielectric layer according to the invention, it suffices that the outermost surface is provided by the non-lead-base high-permittivity dielectric layer. These layers may be alternately deposited as long as the outermost surface is provided by the non-lead-base high-permittivity dielectric layer. With such a construction, the excessive lead components in the lead-base dielectric layers are effectively prevented from diffusion by the alternately deposited non-lead-base high-permittivity dielectric layers, and the lead component diffusion-preventing effect of the non-lead-base high-permittivity dielectric layer disposed at the outermost surface becomes more enhanced. The same construction is also effective for avoiding the problem associated with the sputtering technique that when a layer having an increased thickness is deposited, more asperities are introduced in the film surface.

The material of which the light emitting layer is formed is not critical, and well-known materials such as the aforementioned Mn-doped ZnS can be used. Of these materials, SrS:Ce is especially preferred because excellent characteristics are obtainable. The thickness of the light emitting layer is not critical. However, too thick a layer requires an increased drive voltage whereas too thin a layer results in a low emission efficiency. Illustratively, the light emitting layer is preferably about 100 to 2,000 nm thick, although the thickness varies depending on the identity of the fluorescent material.

In forming the light emitting layer, any vapor phase deposition technique may be used. The preferred vapor phase deposition techniques include physical vapor deposition such as sputtering or evaporation, and chemical vapor deposition (CVD). Also, as previously described, when a light emitting layer of SrS:Ce is formed in a $H_2S$ atmosphere at a substrate temperature of 500 to 600° C. by an electron beam evaporation technique, the resulting light emitting layer can be of high purity.

Following the formation of the light emitting layer, heat treatment is preferably carried out. Heat treatment may be carried out after an electrode layer, a dielectric layer, and a light emitting layer are sequentially deposited from the substrate side. Alternatively, heat treatment (cap annealing) may be carried out after an electrode layer, a dielectric layer, a light emitting layer and an insulator layer are sequentially deposited from the substrate side or after an electrode layer is further formed thereon. The temperature of heat treatment depends on the identity of the light emitting layer, and in the case of SrS:Ce, is 500 to 600° C. or higher, but below the firing temperature of the dielectric layer. The treating time is preferably 10 to 600 minutes. The atmosphere during heat treatment is preferably argon.

As described above, the essential conditions under which a light emitting layer of SrS:Ce etc. having excellent characteristics is formed include deposition in vacuum or a reducing atmosphere and at a high temperature of at least 500° C. and subsequent heat treatment under atmospheric pressure and at a high temperature. As opposed to the prior art technique which cannot avoid the problem of reaction and diffusion of the lead component in the dielectric layer with the light emitting layer, the EL device of the invention is very effective because the detrimental effect of lead component on the light emitting layer is completely prevented.

The thin-film insulator layer 17 and/or 15 may be omitted as previously suggested although the provision of these layers is preferred.

The main purposes of the thin-film insulator layers are to adjust the electron state at the interface between the light emitting layer and the dielectric layer for rendering stable and efficient the injection of electrons into the light emitting layer and to establish the electron state symmetrically on the opposite surfaces of the light emitting layer for improving the positive-negative symmetry of luminescent characteristics upon AC driving. Since the function of maintaining dielectric strength as the typical role of the dielectric layer need not be considered, the thickness may be small.

The thin-film insulator layers preferably have a resistivity of at least about $10^8$ Ω·cm, especially about $10^{10}$ to $10^{18}$ Ω·cm. A material having a relatively high permittivity as well is preferred. The permittivity $\in$ is preferably at least 3. The materials of which the thin-film insulator layers are made include, for example, silicon oxide ($SiO_2$), silicon nitride (SiN), tantalum oxide ($Ta_2O_5$), yttrium oxide ($Y_2O_3$), zirconia ($ZrO_2$), silicon oxynitride (SiON), alumina ($Al_2O_3$), etc. In forming the thin-film insulator layer, sputtering, evaporation, and CVD techniques may be used. The thin-film insulator layer preferably has a thickness of about 10 to 1,000 nm, especially about 20 to 200 nm.

The transparent electrode layer is formed of electrically conductive oxide materials such as ITO, tin oxide ($SnO_2$) and ZnO—Al having a thickness of 0.2 to 1 μm. In forming the transparent electrode layer, well-known techniques such as sputtering and evaporation may be used.

Although the above-illustrated EL device has only one light emitting layer, the EL device of the invention is not limited to the illustrated construction. For example, a plurality of light emitting layers may be stacked in the thickness direction, or a plurality of light emitting layers (pixels) of different type are combined in a planar arrangement so as to define a matrix pattern.

Since the dielectric layer on which the light emitting layer lies has a very smooth or flat surface, a high dielectric strength, and no defects, and completely prevents any damage to the light emitting layer by the excessive lead component in the dielectric layer, the EL device of the invention features a high luminance and long-term reliability of luminance, facilitating the construction of high performance and precision definition displays. The manufacturing process is easy, and the manufacturing cost can be kept reduced.

EXAMPLE

Examples of the invention are given below by way of illustration.

Using a screen printing technique, a commercially available Ag—Pd paste was printed over the entire surface of a 99.6% pure alumina substrate so as to give a thickness of 3 μm after firing. This was fired at 850° C. The lower electrode layer was patterned into a plurality of stripes of 300 μm wide with a space of 30 μm by a photo-etching process.

On the substrate having the lower electrode formed thereon, a dielectric ceramic thick film was formed by a screen printing technique. The thick-film paste used herein was a thick-film dielectric paste 4210C by ESL, and screen printing and drying steps were repeated until a film thickness of 30 μm after firing was reached.

The thick-film paste is based on a $Pb(Mg_{1/3}Nb_{2/3})O_3$ base perovskite dielectric composition and contains an excess of lead oxide as a sintering aid.

After the printing and drying steps, the thick film was fired in a belt furnace having a full air feed atmosphere at 850° C. for 20 minutes. The thick film alone had a permittivity of about 4,000.

Onto the substrate, a PZT dielectric layer as the lead-based dielectric layer was formed by a solution coating-and-firing technique. In forming the dielectric layer by the solution coating-and-firing technique, the steps of applying a sol-gel solution (prepared by the following procedure) onto the substrate as the PZT precursor solution by a spin coating technique and firing the coating at 700° C. for 15 minutes were repeated predetermined times.

For preparing a fundamental sol-gel solution, 8.49 g of lead acetate trihydrate and 4.17 g of 1,3-propane diol were heated and stirred for about 2 hours to form a clear solution. Separately, 3.70 g of a 70 wt % 1-propanol solution of zirconium n-propoxide and 1.58 g of acetyl acetone were heated and stirred in a dry nitrogen atmosphere for 30 minutes, and 3.14 g of a 75 wt % 2-propanol solution of titanium diisopropoxide bisacetyl acetonate and 2.32 g of 1,3-propane diol were added to the solution, which was heated and stirred for 2 hours. These two solutions were mixed at 80° C., heated and stirred in a dry nitrogen atmosphere for 2 hours, obtaining a brown clear solution. The solution was held at 130° C. for several minutes to remove by-products, and heated and stirred for a further 3 hours, yielding a PZT precursor solution.

This precursor solution was adjusted to an appropriate concentration by diluting it with n-propanol, and the steps of application by spin coating and firing were repeated plural times until a PZT layer of 2 $\mu$m thick was formed on the thick film.

The PZT layer formed under the above conditions contained lead component in about 10% excess of the stoichiometry. The PZT film alone had a relative permittivity of 600.

The laminate structure of the thick-film ceramic dielectric layer and the PZT layer by the solution coating-and-firing technique had a permittivity of about 2,800, provided that the overall thickness remained unchanged from 30 $\mu$m.

Next, samples having on the lead-base dielectric layer a $BaTiO_3$ film formed by a solution coating-and-firing technique or a $BaTiO_3$ film, $SrTiO_3$ film or $TiO_2$ film formed by a sputtering technique as the non-lead-base high-permittivity dielectric layer were prepared, and a sample not having the non-lead-base high-permittivity dielectric layer was prepared as a comparative example.

With respect to the conditions under which the $BaTiO_3$ thin film was formed, using a magnetron sputtering apparatus and a $BaTiO_3$ ceramic as a target, film deposition was carried out under a pressure of 4 Pa argon gas, at a frequency of 13.56 MHz and a RF power density of 2 W/cm$^2$. The rate of deposition was about 5 nm/min, and a film thickness of 50 to 400 nm was reached by adjusting the sputtering time. The $BaTiO_3$ thin film thus formed was amorphous, and had a relative permittivity of 500 after heat treatment at 700° C. By x-ray diffraction analysis, the $BaTiO_3$ thin film as heat treated was confirmed to have a perovskite structure. The composition of the $BaTiO_3$ film contained Ba in 5% excess of the stoichiometry.

With respect to the conditions under which the $SrTiO_3$ thin film was formed, using a magnetron sputtering apparatus and a $SrTiO_3$ ceramic as a target, film deposition was carried out under a pressure of 4 Pa argon gas, at a frequency of 13.56 MHz and a RF power density of 2 W/cm$^2$. The rate of deposition was about 4 nm/min, and a film thickness of 400 nm was reached by adjusting the sputtering time. The $SrTiO_3$ thin film thus formed was amorphous, and had a relative permittivity of 250 after heat treatment at 700° C. By x-ray diffraction analysis, the $SrTiO_3$ thin film as heat treated at a temperature of 500° C. or higher was confirmed to have a perovskite structure. The composition of the $SrTiO_3$ film contained Sr in 3% excess of the stoichiometry.

With respect to the conditions under which the $TiO_2$ thin film was formed, using a magnetron sputtering apparatus and a $TiO_2$ ceramic as a target, film deposition was carried out under a pressure of 1 Pa argon gas, at a frequency of 13.56 MHz and a RF power density of 2 W/cm$^2$. The rate of deposition was about 2 nm/min, and a film thickness of 400 nm was reached by adjusting the sputtering time. The thin film thus formed had a relative permittivity of 76 after heat treatment at 600° C.

In forming the $BaTiO_3$ thin film by the solution coating-and-firing technique, the steps of applying a sol-gel solution (prepared by the following procedure) onto the substrate as the $BaTiO_3$ precursor solution by a spin coating technique, heating stepwise at intervals of 200° C. to a maximum temperature of 700° C., and firing the coating at the maximum temperature for 10 minutes were repeated predetermined times.

The $BaTiO_3$ precursor solution was prepared by completely dissolving polyvinyl pyrrolidone (PVP) having a molecular weight of 630,000 in 2-propanol, and adding acetic acid and titanium tetraisopropoxide thereto with stirring, obtaining a clear solution. With stirring, a solution obtained by mixing pure water with barium acetate was added dropwise to the solution. With stirring, the solution was aged in this condition for a predetermined time. The compositional ratio of the respective starting materials were barium acetate:titanium tetraisopropoxide:PVP:acetic acid:pure water:2-propanol=1:1:0.5:9:20:20. The $BaTiO_3$ precursor solution was obtained in this way.

By applying and firing the $BaTiO_3$ precursor solution, a $BaTiO_3$ dielectric layer having a thickness of 0.5 $\mu$m was formed. This film had a relative permittivity of 380 and a composition in agreement with the stoichiometry.

The $BaTiO_3$ film was formed on the PZT films formed by the solution coating-and-firing technique and having a thickness of 2 $\mu$m and 1.5 $\mu$m, and in another sample where the PZT film was not formed, the $BaTiO_3$ film was formed directly on the thick-film ceramic substrate to a thickness of 2 $\mu$m.

On the substrate on which the thick-film ceramic dielectric layer, the lead-base dielectric layer and the non-lead-base high-permittivity dielectric layer were formed as described above, a light emitting layer of SrS:Ce was formed in a $H_2S$ atmosphere by an electron beam evaporation technique while keeping the substrate at a temperature of 500° C. during deposition. Once the light emitting layer was formed, it was heat treated in vacuum at 600° C. for 30 minutes.

Next, a $Si_3N_4$thin film as the insulator layer and an ITO thin film as the upper electrode layer were sequentially formed by a sputtering technique, completing an EL device. The ITO thin film as the upper electrode layer was patterned into stripes of 1 mm wide by using a metal mask during the film deposition. To examine luminescent characteristics, electrodes were extended from the lower electrode and upper transparent electrode in the device structure and an electric field was applied at a frequency of 1 kHz and a pulse width of 50 $\mu$s until the emission luminance was saturated, The tested parameters include emission threshold voltage, saturated luminance, and degradation of ultimate luminance after 100 hours of continuous emission.

TABLE 1

| Sample | Lead-base dielectric layer | Thickness | Non-lead-base high-permittivity dielectric layer | Thickness | Emission voltage | Saturated luminance | Degradation | Remark |
|---|---|---|---|---|---|---|---|---|
| 1 | PZT | 2 μm | — | — | 172 V | 490 cd | 55% | Comparative Example |
| 2 | PZT | 2 μm | SP-BaTiO3 | 0.05 μm | 155 V | 530 cd | 45% | Inventive |
| 3 | PZT | 2 μm | SP-BaTiO3 | 0.1 μm | 150 V | 850 cd | 18% | Inventive |
| 4 | PZT | 2 μm | SP-BaTiO3 | 0.2 μm | 145 V | 1150 cd | 7% | Inventive |
| 5 | PZT | 2 μm | SP-BaTiO3 | 0.4 μm | 146 V | 1200 cd | 6% | Inventive |
| 6 | PZT | 2 μm | SP-SrTiO3 | 0.4 μm | 147 V | 1180 cd | 6% | Inventive |
| 7 | PZT | 2 μm | SP-TiO2 | 0.4 μm | 160 V | 1000 cd | 22% | Inventive |
| 8 | PZT | 2 μm | SOL-BaTiO3 | 0.5 μm | 147 V | 1210 cd | 6% | Inventive |
| 9 | PZT | 1.5 μm | SOL-BaTiO3 | 0.5 μm | 145 V | 1230 cd | 6% | Inventive |
| 10 | PZT | 0 μm | SOL-BaTiO3 | 2.0 μm | 149 V | 1220 cd | 4% | Inventive |

In the Table, SP designates a film formed by sputtering technique, and SOL designates a film formed by sol-gel technique.

As a result, the comparative sample not having the non-lead-base high-permittivity dielectric layer showed a degradation as high as 55%, whereas the inventive samples having a $BaTiO_3$ layer formed by the sputtering technique had an ultimate luminance of about 1200 cd/m$^2$, an emission threshold voltage of 140 to 150 V and minimized degradation at a thickness of 0.2 μm or greater. At a thickness of 0.1 μm or less, the samples showed an increased emission threshold voltage, a lower ultimate luminance and substantial degradation. The samples having a $SrTiO_3$ layer had substantially the same characteristics as the $BaTiO_3$ layer of the identical thickness except for a slight increase of emission threshold voltage. The samples having a $BaTiO_3$ layer formed by the solution coating-and-firing technique had substantially the same characteristics as the $BaTiO_3$ layer formed by the sputtering technique except for a slight increase of emission threshold voltage.

The samples having a $TiO_2$ film showed an increased threshold voltage, a reduced luminance and substantial degradation as compared with the samples having the $BaTiO_3$ layer of the identical thickness.

The structure having PZT alone as a comparative example showed an increased emission threshold voltage, a reduced luminance and substantial degradation and was prone to breakdown under the applied voltage near the ultimate luminance.

As is evident from these results, the structure using a non-lead-base high-permittivity perovskite layer as the non-lead-base high-permittivity dielectric layer becomes effective from a thickness of at least 0.1 μm, and exhibits a remarkable increase of emission luminance, lowering of threshold voltage and improvement in reliability at a thickness of at least 0.2 μm.

This suggests that the diffusion of lead component from the lead-base dielectric layer to the light emitting layer is effectively restrained.

The $TiO_2$ layer was recognized effective as a reaction inhibiting layer, but exhibited a low saturated luminance, a high emission threshold voltage and substantial degradation as compared with the perovskite layer. It is presumed that the $TiO_2$ film reacts with excessive lead in the PZT layer to partially form $PbTiO_3$ and fails to achieve a complete function as the reaction inhibiting layer.

Benefits of the Invention

The invention solves the problem of prior art EL devices that undesirable defects form in dielectric layers, and especially the problems of EL devices having dielectric layers of lead-base dielectric material including a lowering, variation and change with time of the luminance of light emission, and thereby provides an EL device ensuring high display quality and a method for manufacturing the same at a low cost.

What is claimed is:

1. An EL device comprising at least an electrically insulating substrate and a structure including an electrode layer, a dielectric layer, a light emitting layer and a transparent electrode layer stacked on the substrate in the described order, wherein said dielectric layer is a laminate including, stacked in the following order relative to the substrate, of a first thick-film ceramic high-permittivity dielectric layer whose composition contains at least lead, a second high permittivity layer whose composition contains at least lead, and a third high-permittivity layer whose composition is free of at least lead.

2. The EL device of claim 1 wherein said third high-permittivity layer is formed of a perovskite structure dielectric material whose composition is free of at least lead.

3. The EL device of claim 1 wherein said second and third high-permittivity layers are formed by a solution coating-and-firing technique.

4. The EL device of claim 1 wherein said second high-permittivity layer is formed by a solution coating-and-firing technique, and said third high-permittivity layer is formed by a sputtering technique.

5. An EL device comprising at least an electrically insulating substrate and a structure including an electrode layer, a dielectric layer, a light emitting layer and a transparent electrode layer stacked on the substrate in the described order, wherein said dielectric layer is a laminate, stacked in the following order relative to the substrate, including a first thick-film ceramic high-permittivity dielectric layer whose composition contains at least lead and a second high-permittivity layer formed of a dielectric material whose composition is free of at least lead.

6. The EL device of claim 5 wherein said second high-permittivity layer is formed of a perovskite structure dielectric material whose composition is free of at least lead.

7. The EL device of claim 5 wherein said second high-permittivity layer is formed by a solution coating-and-firing technique.

8. The EL device of claim 1, wherein said high-permittivity layer free of at least lead is $BaTiO_3$.

9. The EL device of claim 5, wherein said high-permittivity layer free of at least lead is $BaTiO_3$.

10. The EL device of claim 1, wherein said high-permittivity layer free of at least lead is $SrTiO_3$.

11. The EL device of claim 5, wherein said high-permittivity layer free of at least lead is $SrTiO_3$.

12. The EL device of claim 1, wherein said high-permittivity layer free of at least lead is $TiO_2$.

13. The EL device of claim 5, wherein said high-permittivity layer free of at least lead is $TiO_2$.

14. An EL device as claimed in claim 5, wherein the second high-permittivity layer is formed by sputtering.

15. An EL device as claimed in claim 1, wherein the second high-permittivity layer has a thickness of 0.5 to 2 $\mu$m and the first layer has a thickness of at least 10 $\mu$m.

16. An EL device as claimed in claim 1, wherein the first and second high-permittivity layer each are formed from an oxide of the formula $ABO_3$, wherein A contains lead and B is one or more element selected from the group consisting of Ti, Zr, Hf, Sn, Nb, Mg, Ni and Ta and the first and second layer are different in B.

17. An El device as claimed in claim 1, wherein the first layer consists essentially of Pb $(Mg_{1/2}\ Ni_{2/3})O_3$ and the second layer comprises lead.

18. An EL device as claimed in claim 5, wherein the first layer consists essentially of $Pb(Mg_{1/2}Ni_{2/3})O_3$, wherein the second layer is formed of a perovskite structure dielectric material whose composition is free of lead.

19. An EL device as claimed in claim 5, wherein the first layer consists essentially of $Pb(Mg_{1/2}Ni_{2/3})O_3$, wherein the second layer is formed of a perovskite structure dielectric material whose composition is free of lead and consists of Ti element.

20. An EL device as claimed in claim 5, wherein the first layer consists essentially of $Pb(Mg_{1/2}Ni_{2/3})O_3$, wherein the second layer is formed of a perovskite structure dielectric material whose composition is free of lead and consists of Nb element.

* * * * *

UNITED STATES PATENT AND TRADEMARK OFFICE

CERTIFICATE OF CORRECTION

PATENT NO. : 6,677,059 B2
DATED : January 13, 2004
INVENTOR(S) : Shirakawa et al.

It is certified that error appears in the above-identified patent and that said Letters Patent is hereby corrected as shown below:

Title page,
Items [*] and [45], should read:

-- [*] Notice: Subject to any disclaimer, the term of this patent is extended or adjusted under 35 U.S.C. 154(b) by 43 days.

[45] **Date of Patent: *Jan. 13, 2004** --

Item [75], Inventors, should read:
-- [75] Inventors: Yukihiko Shirakawa, Tokyo (JP); Masashi Miwa, Tokyo (JP); Katsuto Nagano, Tokyo (JP) --

Signed and Sealed this

Eighteenth Day of January, 2005

JON W. DUDAS
*Director of the United States Patent and Trademark Office*